US005199575A

United States Patent [19]

McHugh

[11] Patent Number: 5,199,575

[45] Date of Patent: Apr. 6, 1993

[54] NON-DESTRUCTIVE DETECTION OF A SPOILED LIQUID NUTRITIONAL PRODUCT IN A SEALED CONTAINER

[75] Inventor: John R. McHugh, Worthington, Ohio

[73] Assignee: Abbott Laboratories, Abbott Park, Ill.

[21] Appl. No.: 886,202

[22] Filed: May 21, 1992

[51] Int. Cl.[5] ..... B07C 5/00

[52] U.S. Cl. ..... 209/522; 209/692

[58] Field of Search ..... 198/398, 456, 457; 209/692, 691, 522

[56] References Cited

U.S. PATENT DOCUMENTS

| | | | |
|---|---|---|---|
| Re. 31,817 | 8/1985 | Melkonian et al. | 209/692 |
| 738,699 | 9/1903 | Rinker | 209/692 |
| 1,114,935 | 10/1914 | Sutton et al. | 209/692 |
| 1,283,284 | 10/1918 | Payne | 209/692 |
| 2,570,395 | 10/1951 | Siegal | 209/522 |
| 2,658,616 | 11/1953 | Stutzman | 209/636 |
| 3,978,986 | 9/1976 | Schmidt et al. | 209/692 |
| 4,760,925 | 8/1988 | Stehle et al. | 209/692 |

FOREIGN PATENT DOCUMENTS

| | | | |
|---|---|---|---|
| 625605 | 6/1949 | United Kingdom | 209/692 |

*Primary Examiner*—H. Grant Skaggs

*Attorney, Agent, or Firm*—Lonnie R. Drayer; Donald O. Nickey

[57] ABSTRACT

A non-destructive, spoilage detection device has a conveyor with a top surface, an upper edge, a lower edge, a first end, a second end, a container ingress area, a first container egress area and a second container egress area. The conveyor's top surface is inclined downwardly from the upper edge to the lower edge so that containers introduced onto the conveyor will roll from the upper edge towards the lower edge as they move toward the first end of the conveyor. Containers of non-spoiled liquid food product exit the conveyor at a first container egress area located along the lower edge of the conveyor, while containers of spoiled liquid food product exit the conveyor at a second container egress area located along the first end of the conveyor. There is also disclosed a method for utilizing the device of this invention for the non-destructive detection of spoilage of liquid food products in sealed containers.

12 Claims, 1 Drawing Sheet

NON-DESTRUCTIVE DETECTION OF A SPOILED LIQUID NUTRITIONAL PRODUCT IN A SEALED CONTAINER

TECHNICAL FIELD

The present invention relates generally to a non-destructive method for detecting spoilage of a liquid food product in a sealed cylindrical container, and more particularly, to such a method and apparatus for accomplishing the method which features an inclined conveyor.

BACKGROUND ART

Quality control is extremely important in the nutritional industry. Manufacturers spend substantial amounts of money in attempts to insure that their packaged liquid food products have not been contaminated. In some instances, a contaminated or spoiled liquid food product can easily be detected. For example, if gas producing bacteria are introduced into a liquid food product, a container holding the product maybe deformed due to bloating. As another example, a spoiled liquid nutritional product packaged in glass or translucent plastic often permits visual inspection of the liquid food product. As used herein and in the claims, "liquid nutritional product" is understood to mean a food in a liquid state, and a "liquid state" is understood to mean a state of matter wherein the food is practically incompressible, maintains its volume while conforming to the shape of a container, and may evaporate from an open container. Examples of liquid nutritional products in which spoilage may be detected by the method of the present invention include infant formula, medical nutritional products, beverages, puddings, yogurts, jellies, soups, and fruit and vegetable juices.

In some cases, no gas is produced, and when the liquid nutritional product spoils it does not become visibly discolored. One such condition of spoilage is known in the food industry as a flat/sour. Spoilage may be caused either by (a) container damage which permits the introduction of bacteria or micro-organisms, or (b) the contamination may be caused by improper sterilization of the liquid food product. In a flat/sour, micro-organisms "burped" into the can after sterilization can cause the product to curdle.

An incubation procedure allows the stored liquid food product to sit, often for between 2 and 4 weeks, in order to permit the growth of bacteria or other micro-organisms if the product is contaminated. The incubation procedure is yet another way in which manufacturers attempt to insure the quality control of their liquid food products. However, if the liquid food product is packaged in either metal cans, or containers having a label which precludes the visual inspection of the liquid food product there are few, if any, effective non-destructive screening procedures to test for the presence of flat/sours.

This is not to say that testing for flat/sours in metal or labeled containers is impossible. Flat/sours can still often be detected by physically shaking and handling individual cans. However, such a method obviously is extremely slow, somewhat subjective, and commercially impractical. Therefore, the need exists for a method which can efficiently detect the presence of flat/sours without shaking individual cans, or opening them in a destructive testing method.

The apparatus and method of the present invention meet this need through the employment of an inclined conveyor to separate containers suspected of containing spoiled liquid food products from containers of unspoiled food. Means for separating solid materials using a conveyor or inclined surface are well known in the prior art. Examples of such prior art include Rinker, U.S. Pat. No. 738,699; Sutton, et al. U.S. Pat. No. 1,114,935; Payne, U.S. Pat. No. 1,283,284; Stutzman, U.S. Pat. No. 2,658,616; and Schmidt et al., U.S. Pat. No. 3,978,986.

Rinker, U.S. Pat. No. 738,699, discloses a grain separator comprising a moving inclined belt with a feeder which discharges seeds near one top corner, so that seeds rolling more or less slowly according to their shape will be discharged into various receivers. Seeds of a relatively spherical shape are discharged first, while those seeds which depart from the spherical form will roll more slowly down the inclined surface of the belt and be discharged into other containers. Rinker teaches a method of separating objects based upon the shape of an object, and not with regard to whether there is any spoilage.

Sutton et al., U.S. Pat. No. 1,114,935, discloses a process and apparatus for sizing or classifying comminuted solid materials, with this process being dependent on the volume or size of the individual objects. Once again, a moving belt is involved, with the belt being rough and undulating, and the separation has nothing to do with the detection of spoilage.

Payne, U.S. Pat. No. 1,283,284, discloses a method and apparatus for the grading or sizing of materials, with the method being based on the equilibrium of the various solid particles relative to the distance between the particle's center of gravity and its point of support on an inclined surface. As in Sutton et al., the method of Payne is dependent on the size of the various solid particles, and has nothing to do with the detection of spoilage.

Stutzman, U.S. Pat. No. 2,658,616, discloses a process for classifying solid iron shots of similar sizes. The Stutzman process classifies the iron shots based upon their shape, i.e. spherical or nearly spherical, all the way to tear drop shaped pellets, and detection of spoilage is not involved.

Finally, Schmidt, et al. U.S. Pat. No. 3,978,986, discloses a process and apparatus for separating aspherical particles from spherical particles. Once again, the separation of the solid product is based on shape, and the detection of spoilage is not involved.

None of the above discussed patents disclose or suggest the use of an inclined conveyor in the non-destructive testing of a liquid food product for spoilage.

SUMMARY OF THE INVENTION

There is disclosed herein a non-destructive method for detecting spoilage of a liquid food product in a sealed container, said method comprising: (a) introducing substantially cylindrical containers having an axis of rotation to a conveyor, said containers containing a liquid food product, said conveyor having a top surface, an upper edge, a lower edge, a first end, and a second end, said conveyor top surface being inclined downwardly from the upper edge to the lower edge; (b) having the conveyor transport the containers towards the first end of the conveyor; (c) allowing a container which is not suspected of containing a spoiled liquid food product to roll across the conveyor from the top edge to the bottom edge following a normative path and exit the conveyor at a first location; and (d) allowing a container which does not follow the normative path as it rolls across the conveyor to exit the conveyor at a second location, a container which exists at the second location being suspected of containing a spoiled liquid food product. In the preferred embodiment of the invention, the method includes the additional step of temporarily restraining the containers from proceeding to roll across the conveyor. Further, a container which is not suspected of containing a spoiled liquid food product and exits at the first location does so by rolling onto a container discharge conveyor.

There is also disclosed a non-destructive method for detecting spoilage of a liquid food product in a sealed cylindrical container comprising the steps of: (a) introducing substantially cylindrical containers having an axis of rotation to a primary conveyor, the axes of rotation of said containers being oriented parallel to the direction of motion of the conveyor, said containers containing a liquid food product said conveyor having a top surface, an upper edge, a lower edge, a first end, and a second end, said conveyor surface being inclined downwardly from the upper edge to the lower edge; (b) temporarily restraining the containers from proceeding to roll across the conveyor from the upper edge to the lower edge; (c) having the conveyor transport the containers towards the first end of the primary conveyor; (d) allowing a container which is not suspected of containing a spoiled liquid food product to roll across the conveyor from the top edge to the bottom edge following a normative path to exit the conveyor at a first location; and (e) allowing a container which does not follow the normative path as it roll across the conveyor to exit the conveyor at a second location, a container which exits at the second location being suspected of containing a spoiled liquid food product. Further, a container is introduced to the primary conveyor by rolling from a container feed conveyor onto the primary conveyor. Additionally, a container which exits the primary conveyor at said first location does so by rolling onto a container discharge conveyor.

There is also disclosed a device for non-destructive detection of spoilage of a liquid food product in a sealed substantially cylindrical container comprising: (a) a conveyor having a top surface, an upper edge, a lower edge, a first end, a second end, a container ingress area, a first container egress area, and a second container egress area, said top surface being inclined downwardly from the upper edge to the lower edge of the conveyor such that substantially cylindrical containers introduced onto said conveyor will roll from said upper edge toward said lower edge as the containers move toward said first end of the conveyor, said first container egress area being located along said lower edge of the conveyor, said second container egress area located along said first end of the conveyor; and (b) means for temporarily restraining containers from proceeding across said conveyor, said means for temporarily restraining containers located adjacent said container ingress area. Further, the device includes means for separating containers, said means for separating said containers being located between said first container egress area and said second container egress area. Still further, said container ingress area is located along the upper edge of the conveyor. Still further, said means for temporarily restraining containers is comprised of a first portion, a second portion, and a connecting portion.

The present invention provides a non-destructive, spoilage detection device and a method of using the same which permits the inspection of a liquid food product sealed a substantially cylindrical container to be accomplished in an extremely efficient manner, while at the same time being extremely reliable.

Other aspects and advantages of the invention will be apparent from the following description, the accompanying drawings, and the appended claims.

DETAILED DESCRIPTION OF THE INVENTION

Figure 1:
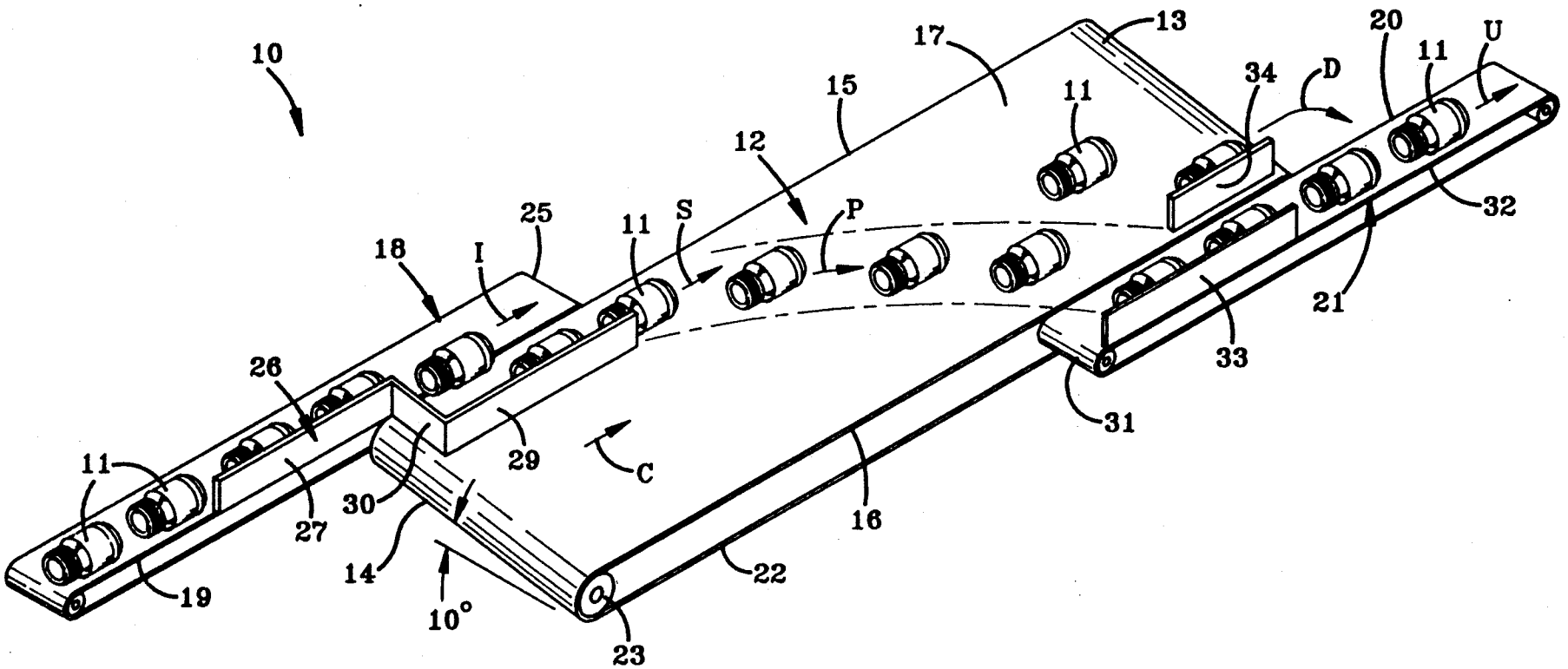
FIG. 1 is a perspective view of the spoilage detection device which is utilized in practicing the method disclosed herein.

Having reference to the drawing, attention is directed to FIG. 1 which illustrates a device which can be used for the non-destructive, detection of spoilage of liquid food products sealed in cylindrical containers, with this device designated generally by the numeral 10 and shown in use with a plurality of substantially cylindrical containers 11. Each container contains a liquid nutritional product. As used herein and in the claims, a "substantially cylindrical container" is understood to mean a container having an axis of rotation and an exterior surface which is circular in cross section with the center of the circle being located on the axis, such that the container may roll down an inclined surface. The containers 11 may either be sealed containers having a substantially cylindrical body shape, or in the case of containers which are not of a substantially cylindrical configuration, such containers may be placed within larger, substantially cylindrical containers for use in conjunction with this invention and inventive method. Typically the containers 11 used in the practice of this invention are fabricated from metal, a non-translucent-plastic, or feature a label which precludes the visual inspection of a liquid food product within the sealed container.

The primary conveyor 12 has a first end 13, a second end 14, an upper edge 15, a lower edge 16, and a conveyor top surface 17. The primary conveyor's first end 13 is located distal from the container feed conveyor 18. Meanwhile, the second end 14 of the primary conveyor is preferably located relatively near the container feed conveyor 18. The upper edge 15 of the primary conveyor extends parallel and adjacent to an edge 19 of the container feed conveyor 18. Similarly, the lower edge 16 of the primary container extends parallel to and adjacent to an edge 20 of the container discharge conveyor 21. The primary conveyor's top surface 17 is preferably formed of a smooth, rubber coated fabric. The primary conveyor's top surface 17 is spaced from the conveyor bottom surface 22 by rollers 23 which in a working example had diameters in the range of 4" to 6".

The container feed conveyor 18 acts as a container inlet or container ingress means. The container feed conveyor moves along inlet path I, such that the substantially cylindrical containers 11 travel towards the first end 25 of the container feed conveyor. In a preferred embodiment, a container feed conveyor 18 moving in a direction parallel to a primary conveyor 12, supplies substantially cylindrical containers 11 to the primary conveyor such that the axis of rotation of each of the substantially cylindrical containers is aligned at least substantially parallel to the direction of travel C of the primary conveyor.

Located near the container feed conveyor 18 is an inlet side rail 26. In a working embodiment there are at least three portions to the inlet side rail. The first portion 27 of the inlet side rail 26 is preferably oriented parallel to an edge 19 of the container feed conveyor 18 and assists in orienting the axis of rotation of each container with both the direction of travel I of the container feed conveyor 18 and the direction of travel C of the primary conveyor 12. Similarly, the second portion 29 of the inlet side rail 26 stabilizes and continues to orient the axis of rotation of each substantially cylindrical container with the direction of travel C of the primary conveyor 12.

The first portion 27 and second portion 29 of the inlet side rail are preferably connected to each other by a connecting portion 30, which is shown as being oriented perpendicular to both the first portion 27 and the second portion 29. The length of the first portion 27 is such that the substantially cylindrical containers 11 can be oriented with their axes of rotation parallel to the direction of travel of I the container feed conveyor. The second portion 29 of the inlet side rail in addition to preferably being parallel to an edge 19 of the container feed conveyor, is also of sufficient length to permit the containers 11 to be oriented with their axes of rotation parallel to the direction of travel C of the primary conveyor. The connecting portion 30 of the inlet side rail is of a length greater than, or at the very least equal to, the greatest diameter of the substantially cylindrical containers 11 such that the substantially cylindrical containers, upon being introduced onto the primary conveyor, do not unnecessarily overlap onto the container feed conveyor, to minimize the probability of the containers prematurely falling off of the primary conveyor 12.

Meanwhile, located at the lower edge 16 of the primary conveyor is a container discharge conveyor 21 which acts as a container outlet means. The container discharge conveyor, has a first end 31, a first edge 20 and second edge 32. The first edge 20 of the container discharge conveyor is located adjacent the lower edge 16 of the primary conveyor, while the second edge 32 of the container discharge conveyor is spaced apart from the primary conveyor 12.

There is also disclosed a first outlet side rail 33 which is located adjacent to the second edge 32 of the container discharge conveyor, as well as preferably located toward the first end 31 of the container discharge conveyor. The first outlet side rail 33 has a side surface against which the substantially cylindrical containers 11 may impact as they roll off of the primary conveyor 12 onto the container discharge conveyor 21. The first outlet side rail 33 stabilizes the containers 11 such that they may proceed in preferably an end-to-end relationship along the container discharge conveyor 21 in direction U.

There is also disclosed a second outlet side rail 34 which is located adjacent the lower edge 16 of the primary conveyor 12. More preferably this second outlet side rail 34 is located near the first end 13 of the primary conveyor 12. Preferably the inlet side rail 26, the first outlet side rail 33, and the second outlet side rail 34 are all positioned in superposed relationship above the various conveyors. These various rails, 26, 33, and 34, may be secured in retained relationship to the conveyors associated with this invention by means not shown. However, such means could include securing rods projecting downwardly from the ceiling or frame members above the conveyor, or alternatively by rods which extend upwardly either from the conveyor frame or the floor. The means of attachment selected for the various rails will depend more on the actual location where the device made in accordance with the invention is to be used. In any event, the location of the various rails relative to the various conveyors and their edges and ends is of greater importance. In connection with a device made in accordance with this invention, in addition to the container inlet path I, there is also disclosed conveyor path C, stabilized path S, normative path P, container discharge path U, and container rejection path D. These various paths may be understood better upon discussion of the method associated with this invention.

In a working example, the substantially cylindrical containers 11, containing a liquid nutritional product, are about 3" in length and spaced 6" center-to-center, such that the top end of one container is spaced about 3" apart from the bottom end of the container which is nearest thereto, proceed along container inlet path I on a container feed conveyor positioned directly adjacent to an upper edge 15 of a primary conveyor 12 and perhaps inclined slightly near the first end 25 of the container feed conveyor, such that substantially cylindrical containers 11 roll from the container feed conveyor onto the primary conveyor. As the substantially cylindrical containers 11 proceed along the container feed conveyor 18 towards the first end 25 of the container feed conveyor, they are stabilized relative to their distance from the first edge 19 of the container feed conveyor by the first portion 27 of the inlet side rail 26.

After the substantially cylindrical containers 11 roll from the container feed conveyor onto the primary conveyor the containers are again stabilized by the second portion 29 of the inlet side rail 26, such that the containers proceed along a stabilized path S, which path preferably is also parallel to both inlet path I and primary conveyor path C. Both stabilized path S and conveyor path C are in the direction of the first end 13 of the primary conveyor. Put another way, the substantially cylindrical containers are oriented on the primary conveyor with their axes of rotation oriented at least substantially parallel to the direction of motion of the primary conveyor.

When the substantially cylindrical containers 11 have traveled on the primary conveyor 12 to the end of the second portion 29 of inlet side rail 26 which is proximal to the first end 13 of the primary conveyor, the substantially cylindrical containers will then travel to one of two locations due in part to the fact that the primary conveyor's top surface 17 is inclined downwardly from the container inlet means 18 toward the container egress means 21. Thus, the upper edge 15 of the primary conveyor is positioned slightly above the lower edge 16 of the primary conveyor relative to the horizontal. In a working example, as shown in FIG. 1, the primary conveyor is inclined 10°, such that the substantially cylindrical containers 11 will roll across the primary conveyor as the conveyor belt proceeds along conveyor path C.

In a working example, the surface speed of the primary conveyor 12 is between 100 to 600 feet per minute, preferably approximately 350 feet per minute. In a working example, 600 to 700 containers having lengths of about 3 inches can be introduced onto and discharged from the primary conveyor each minute. In a working example, the length of the primary conveyor 12 is approximately 10' with the width of the primary conveyor being approximately 2.5'.

As mentioned above, once the substantially cylindrical containers depart from the stabilized path S, they will fall within the range of a normative path P as they roll across the conveyor to exit the conveyor at a first location in the event that there is no spoilage of the liquid food product within the container. Ideally, this first location is between the first end 31 of the container discharge conveyor and the end of the second outlet side rail 34 which is proximal to the first end 31 of the discharge conveyor. FIG. 1 shows both the acceptable range as well as a plurality of containers containing a non-spoiled liquid nutritional product disclosed as falling within the normative path P. However, in the event that the liquid nutritional product in the containers has been subjected to spoilage, the difference in inertia of the liquid food product, caused by the additional curdling will cause the containers to fall outside of the range of the normative path P, due to these containers not rolling across the primary conveyor as fast as containers having an unspoiled liquid food product therein.

Those containers which follow the normative path will exit the primary conveyor at a first location and proceed onto the container discharge conveyor 21 where they will be stabilized by the first outlet side rail 33 and then proceed along a container discharge path U. On the other hand, containers containing a spoiled liquid food product will be diverted by the second outlet side rail 34 and proceed along a container rejection path D for disposal.

For a given liquid nutritional product, conveyor speed, container size and angle of inclination, there will be formed a normative path. Although the precise curve of the normative path could differ depending on the selection of the above variables, for any given combination of variables, there will be formed a normative path with its own range. Ideally the variables will be selected such that the relative locations of the container ingress means 18 and container egress means 21 along with the various rails 28, 33 and 34 need not be modified with respect to their position relative to the primary conveyor 12.

Although conveyors have been utilized in the past in connection with cans or other containers of liquid food products, they have normally been found only in high speed applications where the container speed is over 1000 containers per minute. Further, when the conveyors have been used at a discharge of a hydrostatic sterilizer, there has been no incubation of the liquid food product and consequently no flat/sours would have been present. Therefore, the use of the conveyor-type device disclosed by this invention is totally new within the liquid food product industry.

The liquid food product industry has long sought to enhance the measures taken to assure quality control. This device and method fills a long-felt need by providing a device and method which can efficiently check a large number of containers containing a liquid food product for the presence of spoilage in a non-destructive manner. Additionally, the device and method can be utilized in connection with current liquid food production facilities.

While the form of apparatus and the method of using the same described herein constitutes a preferred embodiment of this invention, it is to be understood that the invention is not limited to this precise form of apparatus or method and that changes may be made therein without departing from the scope of the invention which is defined in the appended claims.

What is claimed is:

1. A non-destructive method for detecting spoilage of a liquid food product in sealed containers comprising the steps of:

(a) introducing a liquid food product sealed inside of substantially cylindrical containers having axes of rotation to a moving, conveyor, said conveyor having a top surface, an upper edge, a lower edge, a first end, and a second end, said conveyor top surface being inclined downwardly from the first edge to the second edge;

(b) having the conveyor move the containers towards the first end of the conveyor;

(c) allowing the containers which fall within the range of a normative path which is followed by a container containing an unspoiled liquid food product as they roll across the conveyor to exit the conveyor at a first location; and (d) allowing containers which do not fall within the range of a normative path as they roll across the conveyor to exit the conveyor at a second location.

2. A non-destructive method for detecting spoilage of a liquid food product in sealed containers according to claim 1 wherein the containers have their axes of rotation oriented parallel to the direction of motion of the conveyor.

3. A non-destructive method for detecting spoilage of a liquid food product in sealed containers according to claim 1 wherein the containers are introduced to the conveyor by rolling.

4. A non-destructive method for detecting spoilage of a liquid food product in sealed containers according to claim 1 wherein the conveyor is moving at a speed of between 100 to 600 feet per minute.

5. A non-destructive method for detecting spoilage of a liquid food product in sealed containers according to claim 1 which includes the additional step of temporarily restraining the containers from proceeding to roll across the conveyor.

6. A non-destructive method for detecting spoilage of a liquid food product in sealed containers according to claim 1 wherein the containers which exit at a first location do so by rolling onto another conveyor.

7. A non-destructive method for detecting spoilage of a liquid food product in sealed containers according to claim 1 wherein the conveyor is inclined about 10° from the horizontal.

8. A non-destructive method for detecting spoilage of a liquid food product in sealed containers comprising the steps of:

(a) introducing a liquid food product sealed in substantially cylindrical containers having axes of rotation to a moving conveyor, said containers having their axes oriented substantially parallel to the direction of motion of the conveyor, said conveyor having a top surface, an upper edge, a lower edge, a first end, and a second end, said conveyor surface being inclined downwardly from the upper edge to the lower edge;

(b) temporarily restraining the containers from proceeding to roll across the conveyor;

(c) having the conveyor move the containers toward the first end of the conveyor;

(d) allowing containers which fall within the range of a normative path which is followed by a container containing an unspoiled liquid food product as they roll across the conveyor to exit the conveyor at a first location; and (e) allowing containers which do not fall within the range of a normative path as they roll across the conveyor to exit the conveyor at a second location.

9. A non-destructive method for detecting spoilage of a liquid food product in sealed containers according to claim 8 wherein the containers are introduced to the conveyor by rolling.

10. A non-destructive method for detecting spoilage of a liquid food product in sealed containers according to claim 8 wherein the containers which exit at said first location do so by rolling onto another conveyor.

11. A non-destructive method for detecting spoilage of a liquid food product in sealed containers according to claim 8 wherein the conveyor is inclined about 10° from the horizontal.

12. A non-destructive method for detecting spoilage of a liquid food product in sealed containers according to claim 8 wherein the conveyor is moving at a speed of between 100 to 600 feet per minute.

* * * * *

UNITED STATES PATENT AND TRADEMARK OFFICE

CERTIFICATE OF CORRECTION

PATENT NO. : 5,199,575

DATED : April 6, 1993

INVENTOR(S) : John R. McHugh

It is certified that error appears in the above-identified patent and that said Letters Patent is hereby corrected as shown below:

In column 8, at line 10, "moving, conveyor," should be --moving conveyor,--

Signed and Sealed this

Twenty-third Day of November, 1993

*Attest:*

*Attesting Officer*

BRUCE LEHMAN

*Commissioner of Patents and Trademarks*